US007152404B2

(12) United States Patent
Francois et al.

(10) Patent No.: US 7,152,404 B2
(45) Date of Patent: Dec. 26, 2006

(54) POWER UNIT WITH RECIPROCATING LINEAR MOVEMENT BASED ON STIRLING MOTOR, AND METHOD USED IN SAID POWER PLANT

(75) Inventors: Pierre Francois, Montrouge (FR); Laurent Prevond, Villeparisis (FR); Georges Descombes, Brunoy (FR)

(73) Assignee: Conservatoire National des Arts et Metiers (CNAM), Paris (FR)

( * ) Notice: Subject to any disclaimer, the term of this patent is extended or adjusted under 35 U.S.C. 154(b) by 0 days.

(21) Appl. No.: 10/466,519

(22) PCT Filed: Jan. 17, 2002

(86) PCT No.: PCT/FR02/00173

§ 371 (c)(1),
(2), (4) Date: Dec. 23, 2003

(87) PCT Pub. No.: WO02/057612

PCT Pub. Date: Jul. 25, 2002

(65) Prior Publication Data

US 2005/0072148 A1 Apr. 7, 2005

(30) Foreign Application Priority Data

Jan. 17, 2001 (FR) ..... 01 00574

(51) Int. Cl.
*F01B 29/10* (2006.01)

(52) U.S. Cl. ..... 60/525; 60/517

(58) Field of Classification Search ..... 60/517, 60/525

See application file for complete search history.

(56) References Cited

U.S. PATENT DOCUMENTS

| | | | | |
|---|---|---|---|---|
| 3,552,120 | A | 1/1971 | Beale | |
| 4,183,214 | A | 1/1980 | Beale et al. | |
| 4,511,805 | A | 4/1985 | Boy-Marcotte et al. | |
| 4,649,283 | A | 3/1987 | Berchowitz et al. | |
| 4,723,410 | A | 2/1988 | Otters | |
| 4,888,951 | A | 12/1989 | Beale | |
| 4,945,726 | A * | 8/1990 | Beale | 60/520 |
| 6,151,896 | A * | 11/2000 | Veringa et al. | 60/524 |

FOREIGN PATENT DOCUMENTS

| | | |
|---|---|---|
| EP | 0 505 039 | 9/1992 |
| EP | 0 505 039 A1 | 9/1992 |
| FR | 1 407 682 | 11/1965 |
| FR | 1.407. 682 | 11/1965 |
| FR | 2 510 181 | 1/1983 |
| GB | 2 290 351 | 12/1995 |
| GB | 2 290 351 A | 12/1995 |

* cited by examiner

*Primary Examiner*—Hoang Nguyen
(74) *Attorney, Agent, or Firm*—Young & Thompson

(57) ABSTRACT

The invention concerns a reciprocating linear movement power unit. The powering element consists of a Stirling heat engine and the generator consists of a piston (1) and displacers (2,3) of the heat engine acting as rotors and fixed electromagnetic elements (6) acting as stator. The Stirling engine comprises in a single working chamber (9) at least a piston (1) and two displacers (2,3) such that the assembly is equivalent to two engines working in opposition. The power stroke of one corresponds to the resisting stroke of the other. Preferably, the generator is of the asynchronous type, but it can consist of synchronous assemblies, with variable reluctance or with permanent magnets.

23 Claims, 4 Drawing Sheets

POWER UNIT WITH RECIPROCATING LINEAR MOVEMENT BASED ON STIRLING MOTOR, AND METHOD USED IN SAID POWER PLANT

The present invention relates to a generating set with reciprocating linear motion based on a Stirling engine. It also relates to a method employed in the said generating set.

In general, the Stirling engine comprises a piston/cylinder assembly enclosing a working fluid. The fluid is brought into contact alternately with a hot source and a cold source. As the fluid is heated, the pressure rises, pushing the working piston, then a displacer transfers the fluid to the cold source and the pressure drops. As the pressure drops, the working piston compresses the fluid. The cycle can then begin again. The reciprocating linear motion produced by the piston can then be used for generating electricity independently.

In the state of the art, document U.S. Pat. No. 4,649,283 describes the principle of a generator consisting of a Stirling engine on which electromagnetic elements are arranged, producing electric power by the reciprocating linear displacement of two pistons joined together and connected to the chamber of the Stirling engine by means of springs.

Document FR2510181 describes a generating set comprising a Stirling engine consisting of a piston and a displacer. One end of the piston is connected to the closed chamber of the engine by means of a spring element. The electromagnetic elements are arranged on the piston and inside the chamber. This document also discloses a Stirling engine consisting of two opposed pistons enclosed in a first chamber, and a displacer enclosed in a second chamber, with communication between the two chambers provided by a pipe that permits the working fluid to flow between these two chambers. The device described in this document does not permit operation close to the Stirling cycle. Moreover, the spring elements used for joining the pistons together will make the device less robust, and the piston heads must be fitted with dampers to prevent collision between them. Furthermore, regulation of the operating conditions is particularly complex as it is carried out by mechanical means that are accessible from outside the unit and by an electronic system.

The aim of the present invention is to overcome the aforementioned drawbacks by proposing a generating set in which the engine part consists of a heat engine of the Stirling type and the generating part consists of an electromagnetic assembly, the moving part of which is comprised of the piston and displacer of the Stirling engine.

One aim of the present invention is to construct an independent generating set suitable for installation in an electric vehicle, for example, and ensuring an energy saving relative to the existing electrical systems, robustness and a particular cleanness.

Another aim of the invention is to construct a generating set that is suitable for producing a wide power range, from a few watts to several thousand kilowatts.

The above aims are achieved with a generating set for converting heat energy to electrical energy based on a heat engine operating according to a Stirling cycle. The said generating set comprises at least one piston with reciprocating linear motion for producing electric power by electromagnetic coupling with fixed magnetic elements. According to the invention, the generating set further comprises at least two displacers arranged in a chamber common to the piston so that the displacers/piston assembly constitutes two engines of the Stirling type operating in opposition.

With such a device, the thermal part consists of the piston and the displacers working in opposition. The "driving" time of one of them corresponds to the "resisting" time of the other. We get the equivalent of two Stirling engines in opposition. As a result it is capable of producing a wide power range, from a few watts to several thousand kilowatts. In addition, the fact that the piston and the displacers are contained in a single chamber increases the robustness of the device. Preferably, the chamber is a completely closed, seamless enclosure. The working fluid, such as helium, enclosed in this chamber can therefore be subjected to considerable pressures, favourable to the overall efficiency of the generating set and its power-weight ratio. Advantageously, the envelope of this chamber is permeable to magnetic fields, and can withstand high pressures, for example 80 bar, as well as the maximum temperatures of the engine that can reach 650° C. The design of this engine is such as to permit operation without periodical maintenance, as the only moving parts, the pistons and displacers, can be lubricated for life.

Document FR2510181 of the prior art describes a generating set in which the pistons do not work in opposition. The pistons of the prior art have the same "driving" time and are returned by a spring device.

The assembly comprising the piston and the fixed magnetic elements constitutes an asynchronous generator. However, a person skilled in the art will readily understand that any type of synchronous or asynchronous electric generator, with variable reluctance, with permanent magnets or with flux commutation, can be used. According to the invention, the electrical part is fully integrated with the thermal part. The magnetic elements can be arranged along the chamber so that the reciprocating linear motion of the displacers also contributes to the generation of electric power. The piston and the displacers are the rotors of the electric generator.

The two displacers can be joined together rigidly. Preferably, however, they are independent of one another, making it possible for the engine to operate according to the theoretical Stirling cycle.

According to an advantageous characteristic of the invention, the two displacers are free to move relative to the chamber, in contrast to the systems of the prior art in which return springs are used.

The generating set according to the invention can in addition include electromagnetic means that are integral with the chamber for guiding the motion of the displacers by electromagnetic coupling. With the displacers guided in this way as actuators, it is possible to create a thermal cycle very close to the theoretical Stirling cycle. When the two displacers are joined together, the control can be on half of the stroke on each of the displacers, otherwise the control is carried over on the entire stroke of each of them.

The electromagnetic means can be arranged on the inside or on the outside of the chamber.

According to one embodiment of the invention, the generating set includes in addition a second piston, the two pistons thus obtained being connected rigidly and arranged on either side of the two displacers. This arrangement means we can have a double electric generator positioned near the ends of the engine, for example of cylindrical shape, in zones that are easy to cool. Furthermore, heating means for supplying heat to the Stirling engine are arranged in a central zone of the cylinder. According to an advantageous variant of the invention, still within the scope of two pistons joined together rigidly, each piston can comprise a plurality of concentric hollow cylinders connected together at one end. These cylinders are intended to slide in other concentric hollow cylinders fitted with fixed magnetic elements and arranged inside the chamber. These pistons are made of a non-magnetic conducting material such as aluminium or some other alloy. With a generator of the asynchronous type, the pistons are the site of induced currents and are subject to a radial repulsive force over their entire surface, which enables them to be levitated during displacement.

According to another embodiment of the invention, the generating set can comprise a Stirling heat engine, for example in the shape of a cylinder, such that heating means for supplying heat to the said engine are arranged on the bases of the cylinder, at the ends. In this case, cooling means can be arranged on the outside of the chamber or can consist of circulation of a fluid in tubes passing through the said chamber.

According to one characteristic of the invention, the stroke of the displacers is substantially twice the stroke of the piston. However, other larger ratios can be envisaged.

According to another aspect of the invention, a method is proposed for converting heat energy to electrical energy by means of a generating set. To accomplish this, two displacers arranged in a chamber forming a Stirling heat engine and comprising at least one piston are controlled in such a way that the displacers/piston assembly operates as two Stirling engines in opposition. Advantageously, a phase displacement of approximately 45° can be introduced in the relative motion between the displacers and the piston.

Preferably, the displacers are able to regenerate the working fluid contained in the chamber in order to permit heat exchange. The actual body of the displacers performs the role of regenerator. However, the construction of external regenerators in the form of a bypass line can also be envisaged.

Other advantages and characteristics of the invention will become apparent from examination of the detailed description of one implementation, which is in no way limitative, and the appended drawings, in which.

Various structures of generating sets according to the invention will now be described.

Figure 1:
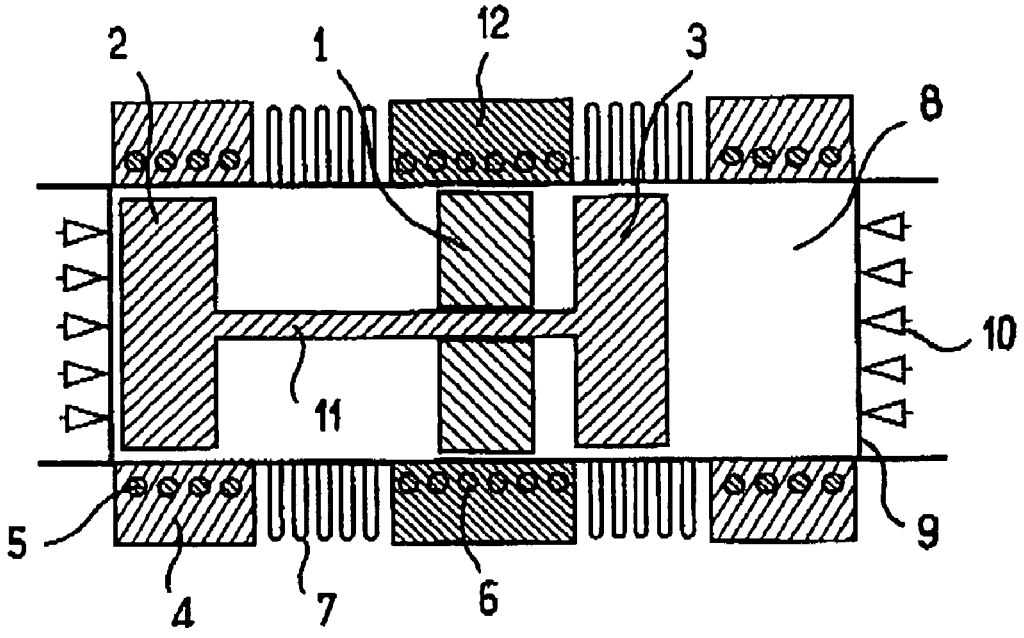
FIG. 1 is a sectional view showing the structure of a generating set according to the invention, constructed according to a structure of type A in which heat supply is to the ends of the engine and the displacers are on each side of the piston.

The structure of type A shown in FIG. 1 has a working chamber 9 of cylindrical shape, with circular or square cross-section. The engine part of the generating set consists on the one hand of a piston 1 of cylindrical shape and with a central hole, and on the other hand of two displacers 2 and 3 of cylindrical shape, joined together by a rigid means 11. This means is able to slide in the hole of piston 1. Thus, the displacers 2 and 3 are arranged on either side of piston 1. The piston and the displacers are enclosed in chamber 9 so that the remaining volume of this chamber is filled with a fluid 8, such as helium. The engine part is equivalent to two Stirling engines in opposition, with supplies of heat 10 to the ends. These heat supplies, for example from a gas-fired boiler, enable a temperature of the order of 650° C. to be reached. Cooling means 7, such as radiators, make it possible to maintain a temperature between 80 and 100° C. in two zones near the centre of the engine. The heat supplies and the cooling radiators are located outside of the chamber. The interior of the cylindrical chamber only contains the piston 1, the displacers 2 and 3 and the working fluid 8.

The external central zone of the chamber is provided with an assembly of magnetic elements 6 such as windings forming the stator part of the electric generator, with the piston constituting its rotor. The windings 6 are integrated in a yoke 12 fixed to the central zone of the chamber. The windings are connected to electrical means (not shown) for generating electric power.

In order to guide the displacers 2 and 3 as actuators and control the frequency of operation of the engine, electromagnetic means 5 are provided, such as windings on the lateral zones of the chamber near the ends. These windings 5 are integrated in blocks 4 in the form of a crown. The displacers are guided over half their stroke on each of the displacers. The whole of the stroke of the displacers is controlled, since they are joined rigidly.

In this structure of type A, omission of the linkage 11 can be envisaged, and in this case the engine can function according to the theoretical Stirling cycle. Moreover, to improve the control of the displacers, it is possible to extend the electromagnetic means 5 and 4 so as to replace the radiators 7, the displacers then being controlled over the whole stroke of each of them. Under these conditions, cooling is carried out by circulation of a liquid within the yoke.

Figure 2:
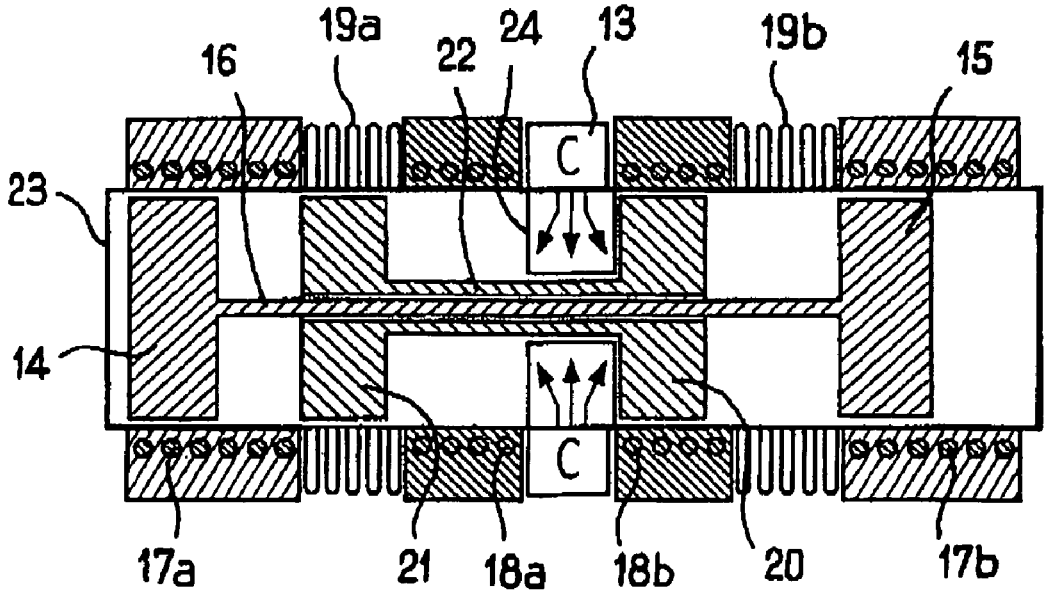
FIG. 2 is a sectional view showing the structure of a generating set according to the invention, constructed according to a structure of type B in which heat supply is to the centre of a twin-piston engine.

FIG. 2 shows a structure of type B in which the chamber 23 has a crown 24 hollowed in the central zone for fitting heating means 13. The engine has two pistons 14 and 15, joined together rigidly by a linkage 16. These pistons are arranged on either side of two displacers 20 and 21 which are also joined together rigidly by means of linkage 22. The displacers/linkage assembly 20, 21 and 22 has a central channel in which the piston linking means 16 slides. In this structure, the magnetic elements 17*a* and 17*b* forming the stator of the electric generator are made up of two crowns arranged at the ends of the chamber, coupled to the pistons 14 and 15. The electromagnetic means 18*a* and 18*b* for controlling the displacers are made up of two crowns arranged on either side of the heating means 13. The radiators 19*a* and 19*b* also consist of two crowns arranged between the magnetic elements 17*a* and 17*b* and the electromagnetic guiding means 18*a* and 18*b*.

With this structure it is possible to have two electric generators (14, 17*a*; 15, 17*b*) close to zones that are easy to cool. This structure can also have several variants, in which the rigid linkage 22 is omitted, the electromagnetic guiding means 18*a* and 18*b* are enlarged to the entire stroke of the displacers, and the radiators 19*a* and 19*b* can be replaced with circulation of liquid in the yoke.

Figure 3:
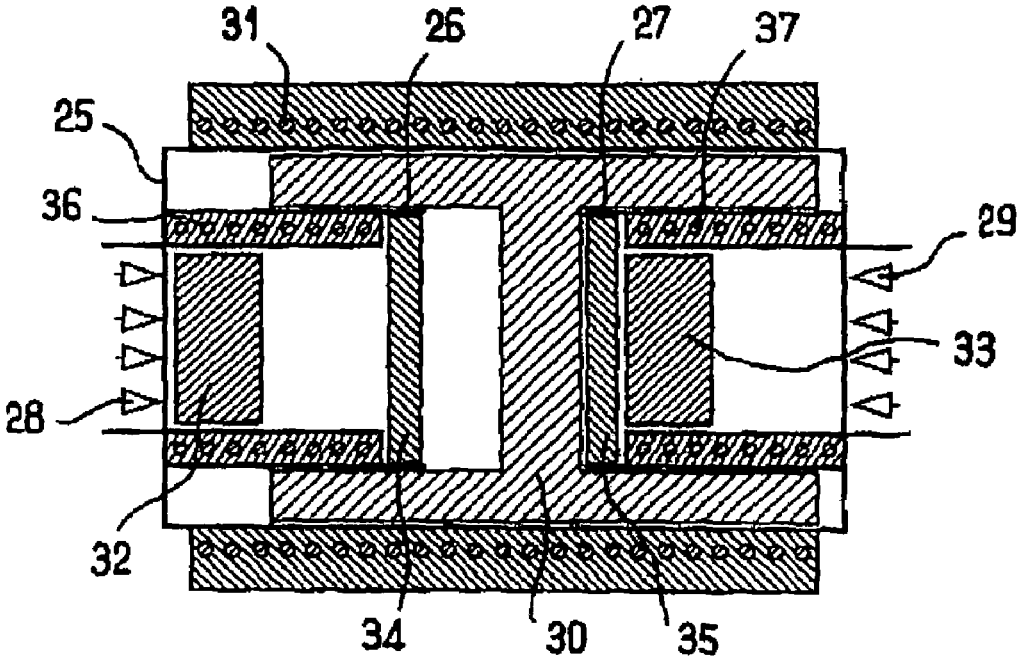
FIG. 3 is a sectional view showing the structure of a generating set according to the invention, constructed according to a structure of type C in which the engine has two concentric shells, the piston being I-shaped.

The structure of type C in FIG. 3 has a chamber 25 in the form of a cylinder of square cross-section. This chamber comprises two cylinders of square cross-section, open and concentric, 26 and 27. These cylinders are arranged inside chamber 25 and each one is fixed to a base of the said chamber. The side walls of these two cylinders have electromagnetic means 36 and 37 for the control of two displacers 32 and 33 sliding inside the two cylinders. The heating means 28 and 29 are arranged at each end of the chamber 25. Cooling is carried out by circulation of a liquid in tubes 34 and 35 passing through chamber 25. The piston 30 is in the form of a large "H" on its side, with its joining line arranged between cylinders 26 and 27. Advantageously, the stator part of the electric generator consists of magnetic windings 31 arranged all the way along two side walls of chamber 25.

Figure 4:
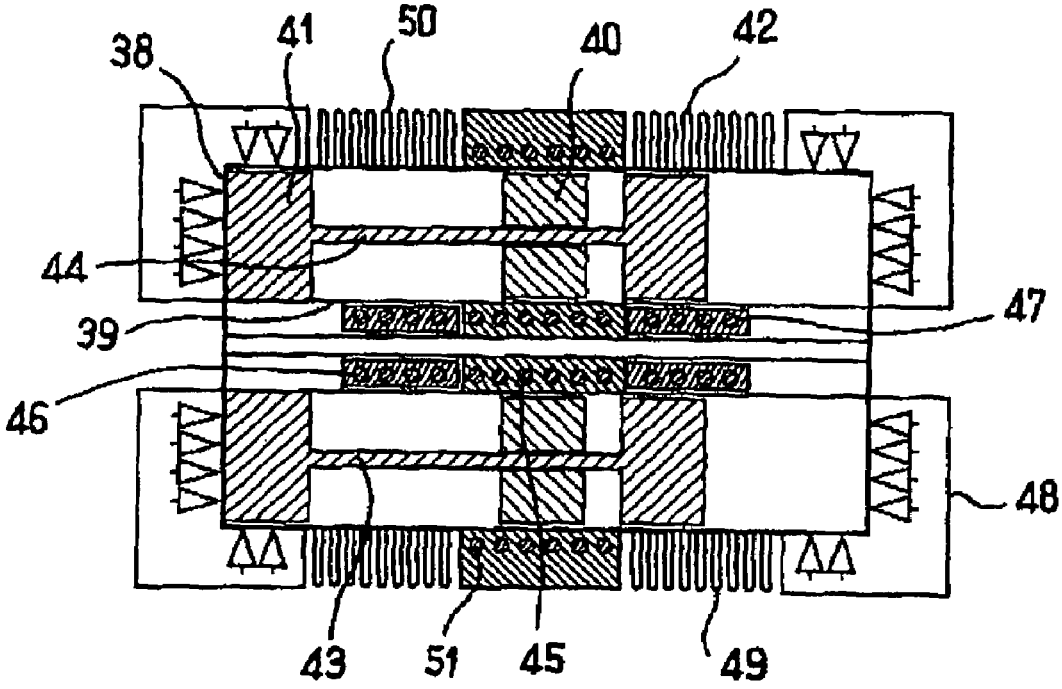
FIG. 4 is a sectional view showing the structure of a generating set according to the invention, constructed according to a structure of type D in which the engine has two concentric cylinders.

FIG. 4 shows a structure of type D comprising two concentric cylinders 38 and 39. The inner cylinder 39 has all the electromagnetic components 45, 46 and 47 serving respectively as stator for the electric generator and as controlling means for the displacers 41 and 42. Other windings 51 serving as stator are arranged on the outside of the outer cylinder 38 on a central zone. Piston 40 and the two displacers move in the outer cylinder 38, serving as the working chamber. The two displacers 41 and 42 are joined together by several rigid connecting means 43, 44 sliding in channels inside piston 40. Radiators 49 and 50 are arranged on the outside of the working chamber 38 on either side of the windings 51. Heating means are positioned at the ends of the working chamber 38.

Figure 5:
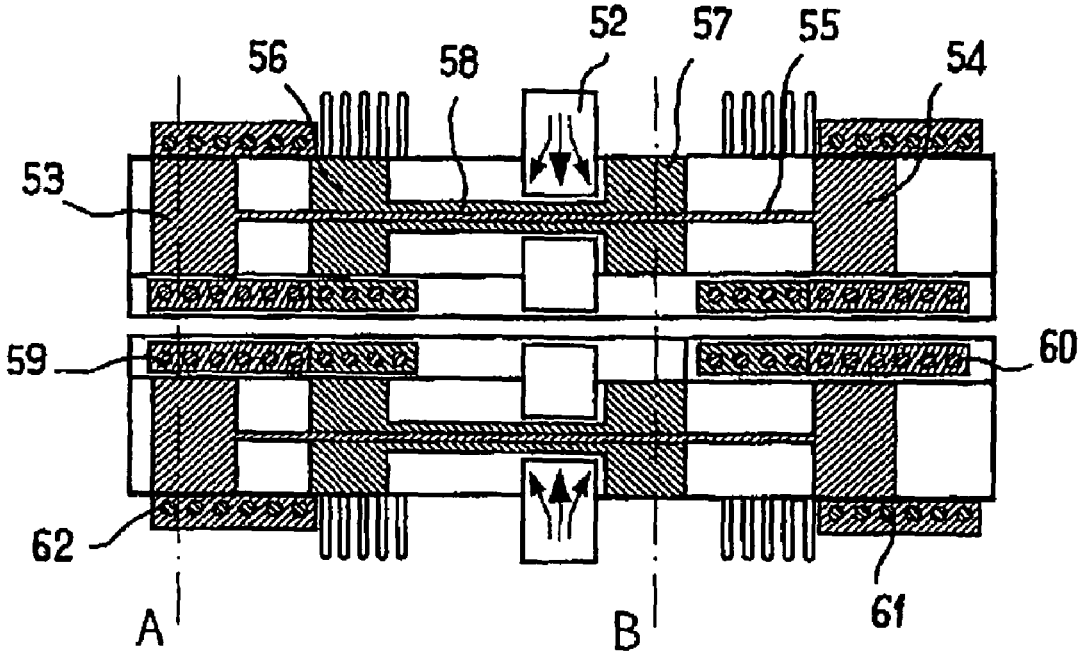
FIG. 5 is a sectional view showing the structure of a generating set according to the invention, constructed according to a structure of type E with heat supply to the centre of the engine.
Figure 6:
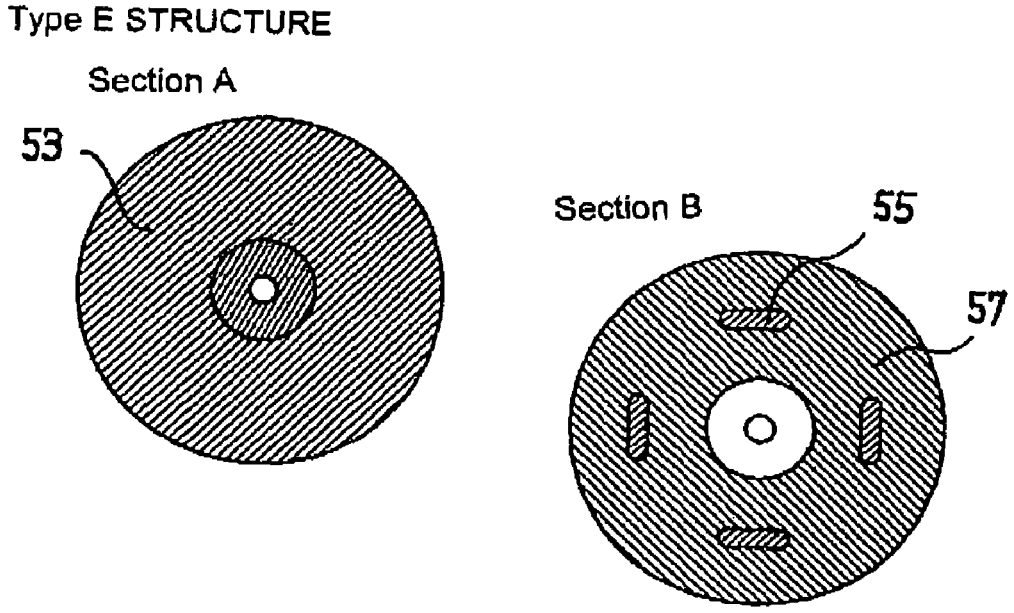
FIG. 6 is a sectional view showing the structure of a generating set according to structure E.

The structure of type E shown in FIG. 5 is similar to the structure of type D, but with heating means 52 provided at the centre of the engine. There are also two pistons 53 and 54 joined together by means of elements 55*a*, 55*b*, 55*c* and 55*d* and positioned on either side of the two displacers 56 and 57. The connecting means 55*a*, 55*b*, 55*c* and 55*d* slide inside a connecting means 58 of the two displacers. The stator windings 59, 60, 61 and 62 are provided near the ends of the engine, which facilitates cooling and increases the efficiency of the electric generator. As with the structure of type B, the stroke of the pistons is damped by an air cushion. FIG. 6 shows two radial sections of the structure of type E. Section A is produced along a plane passing through piston 53. Section B is produced along a plane passing through displacer 57. The four rigid means 55*a*, 55*b*, 55*c* and 55*d* sliding through displacer 57 can be seen.

Figure 7:
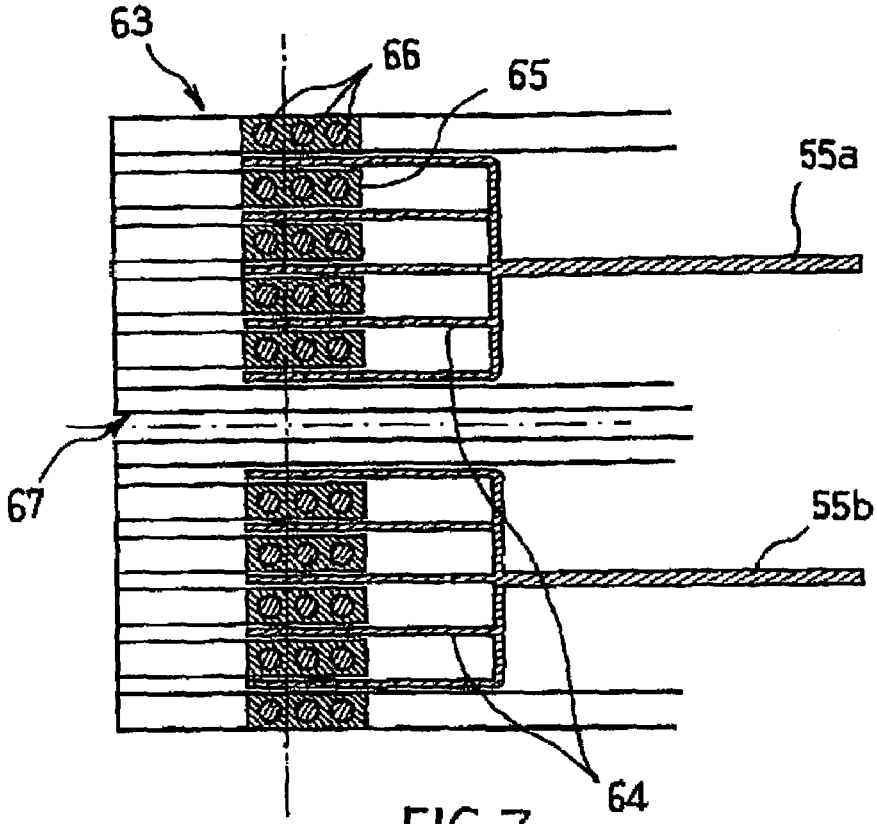
FIG. 7 is a detailed sectional view of a piston for a structure of type E.

A variant of a piston with a structure of type E is shown in detail in the simplified sectional view in FIG. 7. The chamber is formed by two concentric cylinders 63 and 67. The inner concentric cylinder 67 is hollow. The ends of the chamber have projections 65 on their inside surface, regularly spaced in the form of concentric hollow cylinders. These projections enclose magnetic elements or windings 66 forming the stator of the asynchronous generator. The rotor part is formed by a plurality of concentric hollow cylinders 64 which fit into the free space between projections 65. The sectional view therefore shows two intermeshed rakes. The rotor 64 is of a non-magnetic, conducting material such as aluminium. Excitation of the asynchronous generator makes it possible to create induced currents in the rotor. These currents create repulsive forces leading to magnetic levitation of rotor 64 in the free space between projections 65, which reduces friction considerably during the reciprocating motion of the pistons. The surfaces of projections 65 can have centring and guiding means, which are only operative during starting of the generator.

Figure 8:
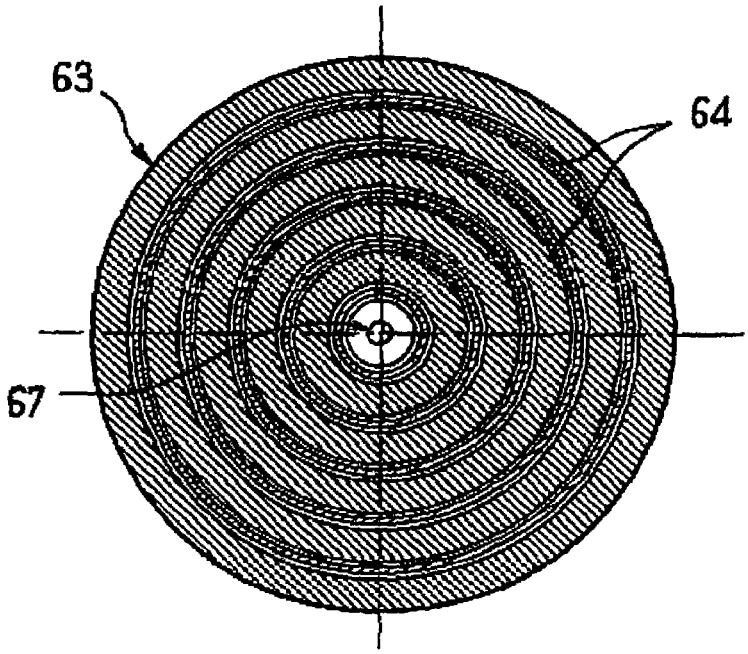
FIG. 8 is a radial sectional view at the level of the pistons, of the structure shown in FIG. 7.

FIG. 8 shows a radial section of a piston with the structure of type E in FIG. 7. This radial section reveals the concentric pistons 64.

In the chamber shown in FIG. 5, the magnetic elements 62 are arranged on the side panels, and electromagnetic generation is therefore carried out in a plane perpendicular to the plane of mechanical (or thermal) generation, which is parallel to the displacement axis of the pistons. Knowing that the electromagnetic force is about ten times lower than the mechanical force, the fact that the piston is split up into a plurality of concentric cylinders, as can be seen in FIG. 7, means that the area of electromagnetic exchange can be increased considerably.

The present invention thus relates to an assembly equivalent to two Stirling engines working in opposition, acting on one and the same piston or on a double piston, in the same working chamber. The displacer is managed electromagnetically as an actuator.

The generating set according to the invention, intended for independent generation of electricity, can be of the stationary type or of the on-board type, and is designed in particular for electricity supply to hybrid electric vehicles, but also for solving any problem of independent electricity generation as a stationary unit, employing systems for cogeneration or trigeneration. This device also provides a solution to the problem of storage of electrical energy (batteries) and the design of electric vehicles offering a reduction in consumption and a reduction in polluting emissions, relative to vehicles with conventional heat engines.

The invention is not, of course, limited to the examples just described, and numerous modifications can be made to these examples while remaining within the scope of the invention.

The invention claimed is:

1. A generating set for converting heat energy to electrical energy based on a heat engine operating according to a Stirling cycle, comprising at least one piston (1) with reciprocating linear motion for producing electrical energy by electromagnetic coupling with fixed magnetic elements (6), characterized in that it further includes at least two free displacers (2, 3) arranged in a chamber (9) that is common to the said piston, in such a way that the displacers/piston assembly constitutes two engines of the Stirling type operating in opposition.

2. A generating set according to claim 1, characterized in that the assembly consisting of the piston and the fixed magnetic elements constitutes an asynchronous generator.

3. A generating set according to claim 1, characterized in that the two displacers are joined together (11) rigidly.

4. A generating set according to claim 1, characterized in that the two displacers (32, 33) are independent of one another.

5. A generating set according to claim 1, characterized in that the two displacers are free to move relative to the chamber.

6. A generating set according to claim 1, characterized in that it further comprises electromagnetic means (5) integral with the chamber for guiding the motion of the displacers by electromagnetic coupling.

7. A generating set according to claim 6, characterized in that the electromagnetic means (36) are arranged inside the chamber.

8. A generating set according to claim 6, characterized in that the electromagnetic means (5) are arranged on the outside of the chamber.

9. A generating set according to claim 1, characterized in that the chamber (9) is a completely closed enclosure.

10. A generating set according to claim 1, characterized in that it further comprises a second piston, the two pistons (14, 15) being joined together (16) rigidly and arranged on either side of the two displacers (20, 21).

11. A generating set according to claim 10, characterized in that each piston (53, 54) comprises a plurality of concentric hollow cylinders (64) connected together at one end, the said cylinders being intended to slide in other concentric hollow cylinders (65) provided with fixed magnetic elements (66) and arranged inside the chamber (63).

12. A generating set according to claim 11, characterized in that each piston (53, 54) comprises a non-magnetic conducting material, permitting the said piston to be levitated during displacement.

13. A generating set according to claim 12, characterized in that the non-magnetic conducting material is aluminium.

14. A generating set according to claim 10, comprising a Stirling heat engine in the form of a cylinder, characterized in that it further comprises heating means (13) for supplying heat to a central zone of the cylinder.

15. A generating set according to claim 1, comprising a Stirling heat engine in the form of a cylinder, characterized in that it further comprises heating means (10) for supplying heat to the bases of the cylinder.

16. A generating set according to claim 1, characterized in that it further comprises cooling means (7) arranged on the outside of the chamber.

17. A generating set according to claim 1, characterized in that it further comprises means (34, 35) for cooling by circulation of a fluid in tubes passing through the said chamber.

18. A generating set according to claim 1, characterized in that the stroke of the displacers is substantially twice the stroke of the piston.

19. A generating set according to claim 1, characterized in that it further comprises magnetic elements arranged along the chamber in such a way that the reciprocating linear motion of the displacers contributes to the generation of electric power.

20. A method for converting heat energy to electrical energy by means of a generating set according to claim 1, characterized in that two displacers (2, 3) arranged in a chamber (9) forming a Stirling heat engine and comprising at least one piston (1) are controlled in such a way that the displacers/piston assembly functions as two Stirling engines in opposition, in which a phase displacement is introduced that is substantially equal to 45° in the relative motion between the displacers and the piston.

21. A method according to claim 20, characterized in that the displacers (2, 3) are able to regenerate the working fluid contained in chamber (9).

22. A method according to claim 20, characterized in that heat is supplied to the ends of the Stirling engine, and in that cooling means are arranged on a central zone of the said engine.

23. A method according to claim 20, characterized in that heat is supplied to a central zone of the Stirling engine, and in that cooling means are arranged on the ends of the said engine.

* * * * *